US006623337B2

(12) United States Patent
Scott et al.

(10) Patent No.: US 6,623,337 B2
(45) Date of Patent: Sep. 23, 2003

(54) BASE-PAD FOR A POLISHING PAD

(75) Inventors: Diane B. Scott, Portland, OR (US); Arthur Richard Baker, III, Kennett Square, PA (US); Tao Zhang, Irvine, CA (US)

(73) Assignee: Rodel Holdings, Inc., Wilmington, DE (US)

( * ) Notice: Subject to any disclaimer, the term of this patent is extended or adjusted under 35 U.S.C. 154(b) by 0 days.

(21) Appl. No.: 09/896,588

(22) Filed: Jun. 29, 2001

(65) Prior Publication Data

US 2002/0081946 A1 Jun. 27, 2002

Related U.S. Application Data

(60) Provisional application No. 60/215,229, filed on Jun. 30, 2000.

(51) Int. Cl.[7] ..... B24B 1/00; B24D 11/00

(52) U.S. Cl. ..... 451/41; 451/527; 451/533

(58) Field of Search ..... 451/41, 526, 527, 451/529, 530, 533

(56) References Cited

U.S. PATENT DOCUMENTS

| | | | | | |
|---|---|---|---|---|---|
| 3,100,721 | A | | 8/1963 | Holden | |
| 3,284,274 | A | | 11/1966 | Hulslander et al. | |
| 4,263,755 | A | * | 4/1981 | Globus | 451/490 |
| 4,841,680 | A | * | 6/1989 | Hoffstein et al. | 15/244.4 |
| 4,927,432 | A | | 5/1990 | Budinger et al. | |
| 5,212,910 | A | | 5/1993 | Breivogel et al. | |
| 5,257,478 | A | | 11/1993 | Hyde et al. | |
| 5,287,663 | A | | 2/1994 | Pierce et al. | |
| 5,396,737 | A | * | 3/1995 | Englund et al. | 451/28 |
| 5,489,233 | A | | 2/1996 | Cook et al. | |
| 5,578,362 | A | | 11/1996 | Reinhardt et al. | |
| 5,605,760 | A | | 2/1997 | Roberts | |
| 5,664,989 | A | | 9/1997 | Nakata et al. | |
| 5,795,218 | A | * | 8/1998 | Doan et al. | 451/526 |
| 5,871,392 | A | | 2/1999 | Meikle et al. | |
| 5,876,269 | A | | 3/1999 | Torii | |
| 5,899,745 | A | | 5/1999 | Kim et al. | |
| 5,899,799 | A | | 5/1999 | Tjaden et al. | |
| 5,900,164 | A | | 5/1999 | Budinger et al. | |
| 5,916,011 | A | * | 6/1999 | Kim et al. | 451/287 |
| 6,017,265 | A | | 1/2000 | Cook et al. | |
| 6,019,666 | A | | 2/2000 | Roberts et al. | |
| 6,022,264 | A | | 2/2000 | Cook et al. | |
| 6,022,268 | A | | 2/2000 | Roberts et al. | |
| 6,135,865 | A | * | 10/2000 | Beardsley et al. | 451/285 |
| 6,241,585 | B1 | * | 6/2001 | White | 451/285 |
| 6,267,659 | B1 | * | 7/2001 | Chen et al. | 451/287 |
| 6,371,833 | B1 | * | 4/2002 | Huckels et al. | 451/285 |
| 6,390,891 | B1 | * | 5/2002 | Guha et al. | 451/287 |

* cited by examiner

*Primary Examiner*—Joseph J. Hail, III
*Assistant Examiner*—Hadi Shakeri
(74) *Attorney, Agent, or Firm*—Gerald K. Kita; Blake T. Biederman

(57) ABSTRACT

The invention is directed to a base-pad for placement under a polishing pad for use with a polishing fluid during a polishing operation, the base-pad having a layer with vertical elongated pores that absorb polishing fluid and that confine absorbed polishing fluid from transport laterally in the base-pad. Micropores in the layer are impermeable to the polishing fluid and permeable to gasses.

10 Claims, 3 Drawing Sheets

BASE-PAD FOR A POLISHING PAD

CROSS REFERENCE TO RELATED APPLICATION

This application claims the benefit of Provisional Application Serial No. 60/215,229 filed Jun. 30, 2000.

BACKGROUND OF THE INVENTION

1. Field of the Invention

The present invention relates to a base-pad for a polishing pad that polishes electrical devices such as semiconductor devices, memory disks or the like, having a variety of substrates, including but not limited to silicon, silicon dioxide, metals, metal oxide, dielectrics (including polymeric dielectrics), ceramics, glass and the like.

2. Discussion of Related Art

CMP (chemical-mechanical polishing or chemical-mechanical planarization) is a manufacturing process performed by a polishing pad in combination with a polishing fluid to polish, for example, a silicon wafer having metal circuits embedded in trenches in a substrate of the wafer. The polishing pad is mounted on a platen of a known polishing apparatus. A base-pad is positioned between the polishing pad and the platen.

A conventional base-pad is formed from foamed sheets or felts impregnated with a polymeric material. However, such a base-pad is too compliant when subjected to the forces occurring during a polishing operation, which can cause the pad to settle into recesses in the substrate that is being polished, which, in turn, causes excessive polishing. As a result, the surfaces of the embedded circuits become polished excessively, causing unwanted recesses known as dishing. Further, such a base-pad absorbs polishing fluid, and is compressed during a polishing operation such that it becomes deformed in all directions, causing the pad to become too compliant. A measure of the compressibility in such different directions provides a prediction that the base-pad will deform in such different directions due to the application of forces.

U.S. Pat. No. 5,212,910 discloses a composite polishing pad having a soft elastomeric material, a hard material such as an epoxy fiberglass composition as an intermediate layer, and a spongy material as the polishing surface.

U.S. Pat. No. 5,257,478 discloses a polishing pad with a resilient layer having a hydrostatic modulus different from that of a polishing layer.

U.S. Pat. No. 5,871,392 discloses an under pad, placed between the platen and a polishing pad, containing a plurality of thermal conductors to reduce temperature gradients across the planarizing surface of the polishing pad.

U.S. Pat. No. 5,287,663 discloses a polishing pad having a rigid layer adjacent to the polishing layer. The rigid layer imparts a controlled rigidity to the polishing layer.

U.S. Pat. No. 5,899,745 discloses an under pad that is positioned under a conventional CMP pad, and having regions of different hardness between the center and the exterior portions of the pad for final wafer profile control.

SUMMARY OF THE INVENTION

The present invention is directed to a base-pad, and to a combination of the base-pad and a polishing pad to provide a high level of planarity and low non-uniformity while polishing. The base-pad of this invention comprises a layer of an anisotropic structure having vertical elongated pores.

Minimal polishing fluid absorption is limited to absorption by the vertical elongated pores, which minimizes lateral transport of absorbed polishing fluid, thereby greatly reducing polishing fluid wicking laterally in the pad during polishing, and which minimizes any change in compressibility of the base-pad and the polishing pad. Further, the anisotropic structure is microporous, having pores that are impervious to the polishing fluid, but are permeable to entrapped gaseous atmosphere, which allows escape of gasses that tend to become entrapped in the base-pad absorbed with polishing fluid. The base-pad of this invention in combination with a polishing pad will polish a semiconductor wafer with a high degree of planarity and a low degree of non-uniformity due to dishing.

DETAILED DESCRIPTION

Figure 1:
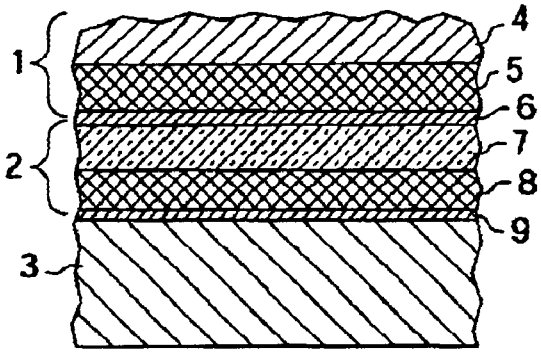
FIG. 1 is a fragmentary view in cross section of a polishing pad positioned over a base-pad, in turn, positioned for attachment to a polishing platen.

FIG. 1 discloses a polishing pad 1 having a polishing layer 4 positioned for being adhered to a substrate 5. A psa pressure-sensitive adhesive) layer 6 is adhered to the back of the substrate 5. The polishing pad 1 is positioned over base-pad 2 with the psa layer 6 in contact with the surface layer 7 of the base-pad 2. The surface layer 7 of the base-pad 2 has an anisotropic structure to be adhered to a flexible substrate 8. The base-pad 2 has a psa layer 9 attached to the flexible substrate 8 adapted to mount to the polishing platen 3.

The terminology, anisotropic, is interpreted to mean that the surface layer 7 of the base-pad 2 has mechanical properties, due to its materials and its structural features, that are not the same in all directions at a point in the body of the layer 7. Specifically, the pore structure of the surface layer 7 of the base-pad 2 has vertical elongated pores that are large enough to absorb polishing fluid, and that confine absorbed polishing fluid from lateral transport within the layer 7 during a polishing process, thereby eliminating fluctuations in both pad compressibility and deformation in certain directions. According to a further embodiment, the base-pad is microporous, meaning having small pores entrained in the structure and material constituent of the base-pad, which micropores are small enough in size to be impermeable to polishing fluid, and yet are permeable by a gaseous atmosphere to allow escape of gasses that would be entrapped by the base-pad that is absorbed with polishing fluid. Such a microporous feature further contributes to the anisotropic characteristics of the base-pad. Escape of gasses further eliminates entrapped gases within the base-pad and within the pores in which the polishing fluid is absorbed, which would have contributed to unwanted deformation of the base-pad in all directions in response to an applied force during a polishing operation.

In use, a polishing pad in combination with the base-pad of the present invention is attached to a flat platen of a known polishing apparatus, and then is moved by operation of the apparatus against a substrate on a semiconductor wafer being polished or planarized, while polishing fluid is dispensed at an interface of the polishing pad and the substrate. The base-pad absorbs some of the polishing fluid in the vertically elongated pores. The base-pad and polishing pad are compressed between the platen and the substrate, such that the base-pad absorbed with polishing fluid undergoes deformation. By having the polishing fluid confined in the vertical elongated pores, the polishing fluid can not escape by transport laterally within the layer 7 and relieve, or otherwise cause a change in, the compression on the base-pad, which would change the deformation of the base-pad. Further, the microporous structure of the base-pad allows for escape of gasses, such as, atmospheric air, to permit displacement of the gasses by the absorbed polishing fluid in the vertically elongated pores, and to permit escape of the gasses from the layer 7, which further contributes to desired anisotropic deformation of the base-pad under compression.

Compressibility of the base-pad 2 is in the range of 4 to 8%. Such compressibility is measured and calculated by a Mitutoyo Digimatic Indicator Model 543-180 with a pressure foot diameter of 5.2 millimeters and a resolution of 0.00127 millimeters. Initial base-pad thickness is measured using a total load of 113+/−5 grams applied to the base-pad, and a total load of 1000+/−5 grams is used for measurement of the final base-pad thickness. Compressibility is the difference between the final and the initial pad thickness divided by the initial pad thickness, expressed as a percentage. Pad compressibility in lateral directions of the anisotropic base-pad according to the invention was found to be within acceptable low limits, and substantially minimized by the anisotropic base-pad.

The flexible substrate 8 of base-pad 2 comprises a single layer or a combination of layers bonded together. The flexible substrate 8 is an embodiment comprising a flexible material capable of being pulled from a roll or easily wound into a roll. A sheet of an engineering plastic can be used as the flexible substrate; particularly useful are polyamides, polyimides, and/or polyester, particularly, polyethylene terephthalate or "PET", and mechanically needled webs of polyesters fibers such as PET, polyamides or polyimides.

The flexible substrate 8 of the base-pad 2, according to an embodiment, has a thickness of 100 to 1,000 microns. According to an embodiment, the flexible substrate 8 has a thickness of about 100 to 500 microns and more an embodiment comprising about 100 to 300 microns.

The layer of anisotropic microporous polymeric material 7 adhered to the flexible substrate 8 of base-pad 2 has a thickness of about 100 to 1,000 microns, more an embodiment comprising 300 to 800 microns, with a surface texture comprising of distinct vertical elongated pores and/or microvoids of varying sizes and dimensions. An embodiment comprising method of forming this layer is by coagulation of a polymer onto the flexible substrate, such as in accordance with Hulslander et al U.S. Pat. No. 3,284,274 issued Nov. 8, 1966 and Holden U.S. Pat. No. 3,100,721 issued Aug. 13, 1963 which patents are hereby incorporated into this specification by reference. The Hulslander patent provides an embodiment comprising structure having elongated vertical pores having microporous sidewalls. In an alternative embodiment, the anisotropic microporous layer can be printed, sprayed, cast or otherwise coated onto the flexible substrate and thereafter solidified by cooling or by a curing reaction.

The polymer that forms the anisotropic microporous structure of the base-pad is a polyurethane or a polyurea. One embodiment comprising polyurethane is a polyetherurethane that is, the reaction product of an alkylene polyol and an organic polyisocyanate selected from the group of aliphatic, cycloaliphatic or aromatic diisocyanates. Another embodiment comprising polyurethane is a polyesterurethane, that is the reaction product of a hydroxy functional polyester and an organic polyisocyanate selected from the group of aliphatic, cycloaliphatic or aromatic diisocyanates.

Examples of polyisocyanates are aromatic diisocyanates such as toluene diisocyanate and diphenylmethane diisocyanate, or aliphatic diisocyanates such as methylene diisocyanate. One particularly an embodiment comprising polyetherurethane is the reaction product of a mixture of polyols, e.g. ethylene glycol, propylene glycol and butanediol and an aromatic diisocyanate, such as 4,4 diphenylmethane diisocyanate. A an embodiment comprising polyesterurethane is the reaction product of a polyester such as dihydroxy-polybutylene adipate and methylene bis(4-phenyl isocyanate).

The polymeric layer could also be made from chain-extended polyurethanes. A variety of chain extenders well known to those skilled in the art can be used. Typical chain extenders used for polymerization may be but not limited to polyols such as butanediol; and polyamines such as ethylene diamine, isopropyl diamine and hydrazine.

One an embodiment comprising process for making the base-pad of this invention comprises the steps of coating the flexible substrate with a solution of a polymeric material that is either a polyurethane or a polyurea to a wet coating thickness in the range of 600 to 1200 microns, with a an embodiment comprising thickness between 700 to 1,000 microns. The coated substrate is then passed into an aqueous bath that contains at least some solvent such as DMF (dimethyl formamide) in the amount of about 10 to 20% to coagulate the polyurethane or polyurea into an anisotropic microporous structure. The coated substrate is then dried, an embodiment comprising in an oven at about 90 to 120° C. for about 5 to 20 minutes, more an embodiment comprising for 8 to 10 minutes to remove any residual solvent and/or water. The surface layer of the anisotropic microporous structure is then buffed to remove a thin layer of polymer ("the skin") and expose the porous substrate, having an vertical elongated pore structure. The resulting base-pad is cut to size and a pressure-sensitive adhesive (rubber-based adhesive) sheet is applied to the unbuffed side of the pad. In use, the base-pad is mounted on the polishing platen of a conventional polishing machine by removing the release liner of the rubber-based adhesive sheet. Then a CMP polishing pad having a pressure-sensitive adhesive (acrylic-based) backing is positioned over the base-pad and the resulting assembly (stack) of base-pad and polishing pad is used to polish electrical devices such as semiconductors using polishing slurries and techniques.

Typically, an acrylic-based adhesive is used to adhere the polishing pad to the base-pad. Acrylic-based adhesives are commercially available as double-sided adhesive sheets. Each side of the adhesive sheet is coated with an acrylic adhesive and has a release liner. To adhere the base-pad to the polishing platen, a removable rubber-based double-sided adhesive sheet is used. Rubber-based double-sided adhesive sheets are also commercially available.

A wide variety of conventional a polishing pad can be used in combination with the base-pad of this invention. These pads typically have a polishing layer comprising a hydrophilic material adhered to a backing layer. Further, according to an embodiment, the polishing layer further comprises a plurality of soft domains and hard domains.

The polishing layer can be grooved, contain perforations or have ridges and the like that can be formed by cutting, embossing, molding, sintering and/or pressing processes. Typical polishing pads are disclosed by: Cook et al U.S. Pat. No. 6,022,264 Roberts et al U.S. Pat. No. 6,022,268 Roberts et al U.S. Pat. No. 6,019,666 Cook et al U.S. Pat. No. 6,017,265 Budinger et al U.S. Pat. No. 5,900,164 Roberts U.S. Pat. No. 5,605,760 Reinhardt et al U.S. Pat. No. 5,578,362 Cook et al U.S. Pat. No. 5,489,233 and Budinger et al U.S. Pat. No. 4,927,432, each of which is incorporated herein by reference.

The combination of a polishing pad with the base-pad of the present invention is an embodiment used with a polishing fluid. During polishing, the polishing fluid is placed between the polishing pad's polishing surface and the substrate to be polished or planarized. As the pad is moved relative to the substrate being polished, grooves in the surface of one embodiment of the polishing pad allow for improved polishing fluid flow along the interface (between the surface of the polishing layer of the polishing pad and the substrate being polished). The improved flow of polishing fluid generally allows for more efficient polishing performance with high planarity and low non-uniformity, less than 5%. Wafer non-uniformity (due, in part, to recesses in the surface) must be as low as possible with a current industry standard of 3% for device wafers. Wafer non-uniformity is typically quantified as the standard deviation of the removal rate, measured at a specified number of points in rings on the wafer surface: e.g. 1 point in the center, 4 points in the next ring and so on. Removal rate is the difference in the thickness of the target layer of the wafer measured at specific points on the wafer surface, prior to and after polishing, divided by the polishing cycle duration.

The polishing fluid is an embodiment comprising a water based solution of chemicals that react with the material that is being removed by CMP polishing, and may or may not require the presence of abrasive particles, depending upon the composition of the polishing layer. For example, a polishing layer comprising abrasive particles may not require abrasive particles in the polishing fluid.

In use, a polishing pad in combination with the base-pad of the present invention is attached to a flat platen of a known polishing apparatus, and then against a flat substrate being polished or planarized. Any surface irregularities on the substrate are removed at a rate which is dependent upon a number of parameters, including: pad pressure on the substrate surface (or vice versa); the speed at which the pad and substrate move in relation to one another; the components of the polishing fluid; and the physical properties of the polishing pad. A uniform force of less than 25 pounds per square inch is typically applied to keep the polishing surface planar with the surface of the substrate being polished.

As the polishing pad polishes, typical micro-topography of the polishing layer of the polishing pad can experience abrasion removal or plastic flow (the micro-protrusions are flattened or are otherwise less pronounced), which can diminish polishing performance. The micro-protrusions are then an embodiment comprising re-formed with further conditioning, such as by moving the pad against an abrasive surface again and causing the material to once again form furrows. One an embodiment comprising abrasive surface for conditioning is a disk which is an embodiment comprising metal embedded with diamond grit of a size in the range of 0.001 to 0.5 millimeters. During conditioning, the pressure between the conditioning disk and the polishing pad is an embodiment comprising between 0.1 to about 25 pounds per square inch. The disk's speed of rotation is an embodiment comprising in the range of 1 to 1000 revolutions per minute. Conditioning can be conducted in the presence of a conditioning fluid, an embodiment comprising a water-based fluid containing abrasive particles.

The following examples illustrate the base-pad of this invention. All parts and percentages are on a weight basis unless otherwise indicated.

EXAMPLES

Example 1

Base-pad SP2100 according to the invention was prepared and used in combination with a polishing pad in a polishing experiment to polish TEOS (tetraethylorthosilicate) wafers. The polishing experiment indicated that Base-Pad SP2100 (The Invention) provided high planarity and low non-uniformity, less than 5%, when compared with another commercially available base-pad, SUBA IV. SUBA IV is a commercially available urethane impregnated polyester felt with a compressibility of 7%.

Base-Pad SP2100 was prepared by extrusion coating a 177.8 $\mu$m thick polyethylene terephthalate (PET) film pre-coated with an adhesion-promoting layer with a polyurethane solution to provide a layer of coating 838.2 $\mu$m thick. The polyurethane solution in DMF (dimethylformamide) contains a polyurethane of ethylene glycol, 1,2 propylene glycol, 1,4 butanediol, and 4,4 diphenylmethane diisocyanate, yellow and red coloring agents, and a surfactant of a polysulfonic acid solution.

The coated film is then passed three times through a water/DMF bath containing 10 to 20% DMF to coagulate the film. The coated film is then passed through an oven at 105° C. for 8 to 10 minutes to remove any residual DMF and water. After drying, the material is then buffed for two passes until a coating thickness of 571.5 $\mu$m is achieved. The resulting material has a compressibility in the range of 4 to 6%.

Base-Pad SP2100 and SUBA IV was used as the base-pad in conjunction with an OXP3000 polishing pad that is a molded polyurethane pad made by Rodel Inc., Newark, Del., to polish TEOS (tetraethylorthosilicate) wafers using identical polishing conditions and ILD 1300 (8MJ-YE1A) polishing fluid which is an aqueous polishing fluid containing fumed silica and ammonium hydroxide designed for oxide polishing. A control polishing test was run with only the OXP3000 polishing pad, without a base-pad.

The base-pad was fastened to the platen of the polishing machine with a removable double-sided rubber-based adhesive sheet. The polishing pad was then attached to the base-pad with a double-sided permanent acrylic adhesive sheet.

A Strasbaugh 6DS-SP polishing machine was used for all polishing tests. All testing was conducted under identical conditions: down force of 7 psi; backpressure of 0.5 psi; platen speed at 51 rpm; carrier speed at 41 rpm; polishing fluid flow rate of 150 ml/min and a test duration of 2 min.

Figure 2:
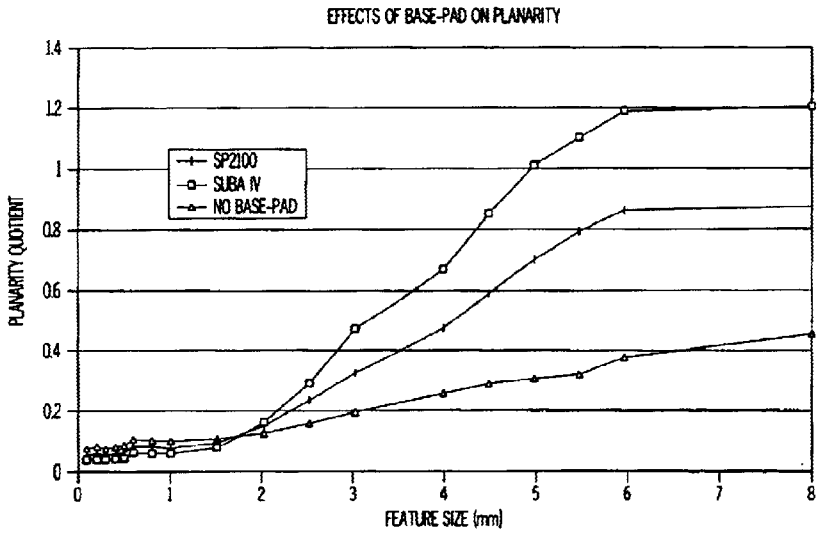
FIG. 2 is a graph disclosing planarity of a substrate as a function of the base-pad.

For each of the a base-pad tested, the planarity quotient was calculated for various feature sizes (in mm). Features are trenches on the wafer surface with identical depths (e.g. 0.00063 mm) and lengths (e.g. 8 mm) but varying widths (e.g. 0.1 to 8 mm). The planarity quotient (PQ), a measure of planarization efficiency, is the ratio of surface material removal at the center of the trench ($R_{down}$) to the surface material removal at the top of the trench ($R_{up}$). FIG. 2 is a plot of PQ versus the trench width (or feature size). With a desired PQ (i.e. planarization efficiency), for e.g. 0.3, a horizontal line may be drawn to intersect the curve for each specific base-pad in FIG. 2, to determine the corresponding feature size, defined as the planarization distance (PD). A longer PD directly corresponds with better planarization. As seen from FIG. 2, higher planarity was achieved without a base-pad. However, the use or non-use of a base-pad affects not only wafer planarity but also wafer non-uniformity reported as % NU. Wafer nonuniformity, as previously described, is the standard deviation of removal rate expressed as a percentage. A high planarity and low non-uniformity is desirable while polishing semiconductor wafers. Without a base-pad, wafer non-uniformity was observed to be about 5 to 6% during polishing tests. Wafer non-uniformity increased to 7 to 8% with SUBA IV as the base-pad. However, the wafer non-uniformity decreased to within a range of 3 to 5% with the base-pad of this invention.

Example 2

Figure 3:
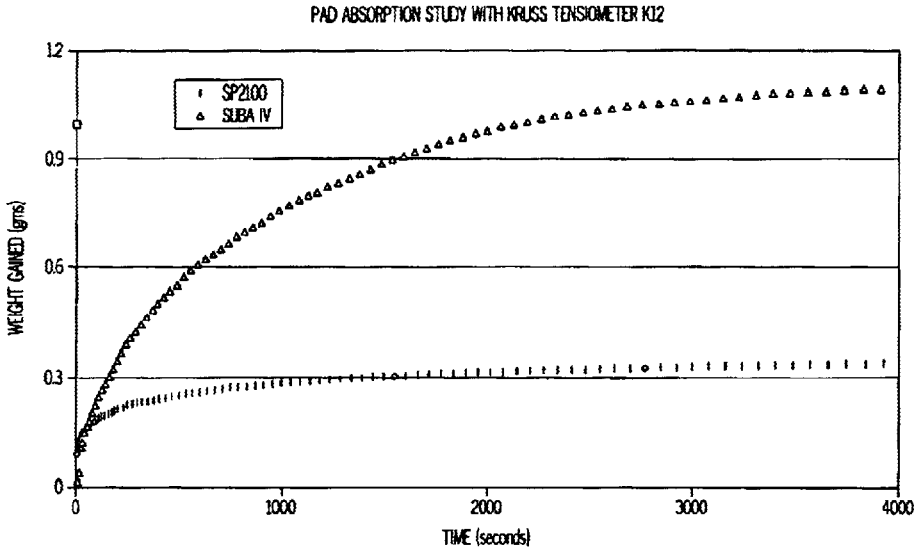
FIG. 3 is a graph disclosing polishing liquid absorption of a base-pad vs. time.

Polishing fluid absorption by Base-Pad SP2100 and SUBA IV was measured using a Kruss Tensiometer. A sample of each base-pad was attached to the metal coupon in the instrument with ILD-1300 in the sample holder. ILD 1300 is an aqueous polishing fluid (polishing fluid) containing fumed silica and ammonium hydroxide designed for oxide polishing. The metal coupon with the base-pad sample attached to it was dipped 6.5 mm into the sample holder. Polishing fluid absorption was then measured as weight change of the base-pad sample per unit time. FIG. 3 shows polishing fluid absorption as a function of time for Base-Pad SP2100 and Suba IV. As indicated in the figure, polishing fluid absorption characteristics for Base-Pad SP2100 are far superior to SUBA IV, a commercially available conventional base-pad.

Embodiments of the invention having been disclosed, other embodiments and modifications are intended to be covered by the spirit and scope of the appended claims.

What is claimed is:

1. An article for use with a polishing fluid for CMP, comprising:

a polishing pad having a base-pad;

the base-pad including a porous layer having a compressibility and having gas permeable micropores impermeable to the polishing fluid and vertical elongated pores for reducing transport of the polishing fluid laterally in the porous layer and decreasing fluctuations in the compressibility of the porous layer during polishing.

2. The base-pad of claim 1 wherein the vertical elongated pores can be absorb the polishing fluid.

3. A base-pad of claim 1 wherein the gas permeable micropores allow escape of gasses entrapped by the base-pad.

4. The base-pad of claim 1 wherein the base-pad is attached to a flexible substrate.

5. The base-pad of claim 1 wherein the compressibility of the base-pad is in a range of 4 to 8 percent as measured with a pressure foot diameter of 5.2 millimeters and a resolution of 0.00127 millimeters, and using an initial load of 113±5 grams and final total load of 1000±5 grams.

6. The base-pad of claim 1 wherein the base-pad contains polyurethane or a polyurea.

7. The base-pad of claim 1 wherein the base-pad contains a chain extended polyurethane.

8. A method of performing chemical mechanical planarization, comprising: polishing a semiconductor wafer with a polishing fluid and a polishing pad; the polishing pad having a base-pad, the base-pad having a porous layer, the porous layer having a compressibility and having gas permeable micropores impermeable to the polishing fluid and vertical elongated pores for reducing transport of the polishing fluid laterally in the porous layer and decreasing fluctuations in the compressibility of the porous layer during the polishing.

9. The method of claim 8 wherein the polishing occurs with the gase permeable micropores allowing escape of gasses entrapped by the base-pad.

10. The method of claim 8 wherein the polishing occurs with the compressibility of the base-pad in a range of 4 to 8 percent as measured with a pressure foot diameter of 5.2 millimeters and a resolution of 0.00127 millimeters, and using an initial load of 113±5 grams and final total load of 1000±5 grams.

* * * * *